US008188390B1

(12) United States Patent
Poirier

(10) Patent No.: US 8,188,390 B1
(45) Date of Patent: May 29, 2012

(54) ELECTROMECHANICAL TOY WITH MOMENTARY ACTUATOR DUAL PURPOSE CAM MECHANISM PRESERVING BATTERY LIFE

(75) Inventor: Mark Alan Poirier, Hubbardston, MA (US)

(73) Assignee: Hasbro, Inc., Pawtucket, RI (US)

( * ) Notice: Subject to any disclaimer, the term of this patent is extended or adjusted under 35 U.S.C. 154(b) by 283 days.

(21) Appl. No.: 12/731,026

(22) Filed: Mar. 24, 2010

(51) Int. Cl.
*H01H 7/00* (2006.01)
*A63H 11/00* (2006.01)

(52) U.S. Cl. ..... 200/38 FA; 200/38 F; 200/35 H; 200/33 B; 446/330; 446/352; 446/353

(58) Field of Classification Search ..... 446/330, 446/351–353, 358, 457, 461, 462, 486; 345/156, 345/157, 160, 161, 163; 200/17 R, 19.01–19.05, 200/19.18, 33 R, 36, 38 R, 38 F, 38 FA, 38 FB, 200/40, 35 A, 33 B, 500, 501, 520, 529, 532–534, 200/535, 329, 337, 35 H, 19.2
See application file for complete search history.

(56) References Cited

U.S. PATENT DOCUMENTS 1,345,052 A 6/1920 Williams
1,601,983 A 10/1926 Savage
1,782,477 A 11/1930 Price
2,641,865 A 6/1953 Gowland
3,164,924 A 1/1965 Iwaya et al.
3,199,248 A 8/1965 Suzuki
3,443,338 A 5/1969 Collins
3,444,340 A * 5/1969 Janoska et al. ..... 200/38 F
3,686,878 A * 8/1972 Patrick et al. ..... 368/263
3,737,595 A * 6/1973 Simmons et al. ..... 200/33 R
3,754,351 A 8/1973 Glass et al.
3,881,075 A * 4/1975 Kitai ..... 200/33 R
3,909,820 A * 9/1975 Nishina ..... 340/309.8
3,911,613 A 10/1975 Morrison et al.
4,114,009 A * 9/1978 Kiuchi et al. ..... 219/622
4,485,281 A * 11/1984 Voland et al. ..... 200/38 R
4,536,167 A 8/1985 Hughes
4,760,318 A 7/1988 Jones
4,878,875 A 11/1989 Pin-Hung et al.
4,916,269 A * 4/1990 Spazierer et al. ..... 200/408
5,746,309 A * 5/1998 Neyer ..... 200/528
5,876,263 A 3/1999 DeCesare et al.
6,142,851 A 11/2000 Lewinski et al.
6,620,024 B2 9/2003 Choi
6,661,239 B1 12/2003 Ozick
6,672,934 B2 1/2004 Hornsby et al.
6,722,939 B2 * 4/2004 An ..... 446/330
6,940,291 B1 9/2005 Ozick
7,062,356 B2 6/2006 Takamura et al.
7,066,782 B1 6/2006 Maddocks et al.

* cited by examiner

*Primary Examiner* — Michael Friedhofer
(74) *Attorney, Agent, or Firm* — Perry Hoffman

(57) ABSTRACT

A low cost cam mechanism facilitating an automatic shut off mechanism preserving battery life in a toy. A rotatable cam including a recess captures an internal actuator and completely shuts down a motor at a defined cam rotation to preserve the battery life in the toy. A resetting biasing lever coupled, to a manually operable actuator advances the cam and is then moved from engagement so as to completely shut down the motor at the defined cam rotation even if the manually operable actuator continues to be depressed. Further Thusly the internal actuator 18 facilitates limited activations of the motor for automatically shutting off a rotating cam mechanism to prevent repetitive continued operation. Further the internal actuator may provide powering up the motor and rotating the cam for "try me" operation for limited demonstrative operations of the toy while packaged or configured in a point of sale environment.

20 Claims, 7 Drawing Sheets

ELECTROMECHANICAL TOY WITH MOMENTARY ACTUATOR DUAL PURPOSE CAM MECHANISM PRESERVING BATTERY LIFE

BACKGROUND OF THE INVENTION

1. Field of the Invention

The present invention relates to toy mechanisms and more particularly to a low cost cam mechanism for a toy repetitively moving appendages creating fun and life like animation and facilitating an automatic shut off mechanism preserving battery life in the toy. The invention also relates to methods for automatically shutting off a rotating cam mechanism either to prevent repetitive continued operation and/or to provide e.g. a "try me" operation for limited demonstrative operation of toy devices and the like while packaged or configured in a point of sale display.

2. Background of the Invention

The toy industry has seen an evolution of technology in recent years which has coincided with consumer demand for more realistic toys embodied as small creatures, animals, dolls, etc. To provide a small doll or toy with fun and realistic movements, a cost-technology trade off has become important. As a result, making movable or animated toys more cost effective has led to the implementation of technologies which seek to preserve the battery life of the toy while also achieving desired movements and animation.

More complex devices seeking to reduce the drain on a power source in a toy have been seen to intermittently stop the motor from running with the use of substantial electronics and complicated operating arrangements incorporating microprocessors and/or integrated circuits. The utilization of integrated circuits and other substantial electronics can reduce power or battery drain, for example with single turn impulse device actuators for use in small devices, but will significantly increase manufacturing costs. As a result, incorporating electronic devices into the manufacture of small movable and animated toys in order to preserve battery life in the toy is not cost effective. Comparatively, the use of mechanical rather than electrical devices for the purpose of preserving the life of the battery in a toy with movable parts or animated appendages is much more cost effective without expensive electronics and has a significantly reduced manufacturing cost.

U.S. Pat. No. 4,536,167 to Hughes for "Rocking Mechanism" discloses a rocking mechanism for a toy mounted on a frame and utilizing a drive wheel intermittently rotated by an electric motor rocking the frame back and forth. A first switch connects the motor to a battery and a second horizontal sensing switch is connected in parallel with the first switch. The second switch energizes the motor causing rotation of the wheel when the frame is balanced and the second switch is in a horizontal position. An unbalancing weight mounted on the wheel then unbalances the frame causing it to rock from the horizontal opening up the second switch. The wheel rotates an attached cam which, when advanced enough, will rotate into contact with and close the first switch activating the motor to drive the wheel until the weight has returned to its balanced position and opened up the first switch.

The rocking mechanism of Hughes includes first and second switches which alternately turn on the motor to keep the frame continuously rocking. The motor is only momentarily stopped during the delay between the first and second switches alternately turning on the motor and no mechanism to completely shut down the motor at a defined point in time is disclosed. Hughes does not disclose an automatic shut off mechanism which halts the motor after a defined rocking cycle or at a defined rocking point but rather, momentarily stops the motor randomly. In Hughes, Rocking of the frame will continue for some time, until the frame is positioned such that neither first nor second switches are closed to activate the motor. To shut down the motor at a defined point a user must manually stop the rocking at the position where neither switch is closed or after many rocks back and forth eventually there will not be enough rocking momentum to advance the cam to close the first switch while simultaneously the second switch will not come to the horizontal position and will also not close.

In another embodiment Hughes discloses a rocking mechanism for a toy mounted on a frame utilizing a pin actuator which controls the unwinding of a spring motor when the frame comes to rest on a surface in a horizontal position. An unbalancing weight mounted on a shaft will revolve when the motor is activated causing the frame to rock back and forth. A linkage stop engages the pin and is positioned to interfere with an oscillating escapement to prevent the spring motor from unwinding until the pin actuator is depressed again, when the frame is in a balance horizontal position on the surface. Again, Hughes does not disclose a mechanism to completely shut down the motor at a defined time frame or rocking cycle.

In the Hughes devices if the pin actuator, which controls the activation of the motor, is continuously depressed the motor cannot be shut down, but rather the Hughes device is designed in this situation to allow the motor to continuously run and completely drain the power source, or completely unwind the motor. Likewise, if the Hughes devices are manually held in a horizontal position, such as would occur if the device was placed in a box, the second switch would continuously energize the motor, again completely draining the power source. Significantly, the Hughes devices do not disclose or suggest a rotatable cam having a recess for capturing an internal actuator and completely shutting down the motor at a defined cam rotation, even if a manually operable actuator continues to be depressed. The Hughes devices also do not disclose or suggest a low cost cam mechanism for a toy repetitively moving appendages for creating fun and life like animation and facilitating an automatic shut off mechanism preserving battery life in the toy. It would be desirable to provide a manually operable actuator to advance a rotatable cam mechanism with a peripheral surface for engaging an internal actuator for activating a motor and repetitively moving one or more appendages, the cam also includes a recess for capturing the internal actuator and completely shutting down the motor at a defined cam rotation, even if a manually operable actuator continues to be depressed.

SUMMARY OF THE INVENTION

The present invention addresses shortcomings of the prior art to provide a low cost cam mechanism preserving the life of a battery in a toy having one or more movable appendages. An internal actuator alternates between a first position where the actuator is captured in a recess on a rotatable cam shutting off the motor, and a second position where the actuator rides along a peripheral surface of the cam activating the motor to rotate the cam and repetitively move the one or more appendages in mechanical communication with the cam. The actuator facilitated limited activations of the motor for automatically shutting off a rotating cam mechanism to prevent repetitive continued operation. Further the actuator may be provided to facilitate such limited activations for "try me" operation for limited operation of moveable appendages and other operations.

In one embodiment of the invention, a cam mechanism facilitating an automatic shut off mechanism for a toy includes a motor, an electrical power source, an electrical switch in a circuit with the motor, an internal actuator adjacent the electrical switch, the actuator is alternately in one of a first position where the motor is not powered and a second position in mechanical communication with the electrical switch for powering the motor, and a rotatable cam coupled with the motor, the rotatable cam including a peripheral cam surface having a recess where the internal actuator in the first position is captured in the recess, and where the internal actuator in the second position rides along the peripheral cam surface outside the recess and is in mechanical communication with the electrical switch powering the motor while the rotatable cam is operated by the motor. A protrusion element at the cam is further included as well as a manually operable actuator for applying a force upon the protrusion and advancing the cam forcing the internal actuator from the first position to the second position powering up the motor and rotating the cam, further rotation of the cam will move the internal actuator to the second position automatically shutting off the motor.

In another embodiment of the invention, the internal actuator pivots between the first and second positions and further comprises a finger projection at an end of the pivoting internal actuator for riding along the peripheral cam surface and for being captured by the recess, and in another embodiment, the electrical switch includes a leaf switch adjacent the pivoting actuator at an end opposite the finger projection. In another embodiment of the invention, the leaf switch closes the electrical circuit powering the motor when in contact with the pivoting actuator in the second position, and opens the electrical circuit shutting off power to the motor when the pivoting actuator is in the first position and pivoted away from contact with the leaf switch.

In another embodiment, the manually operable actuator includes a biased lever for advancing the cam and automatically resetting into position for further cam advancement, and in another embodiment, the protrusion pivots the biased lever from engagement with the cam after one cam revolution preventing inadvertent advancement of the cam if the manually operable actuator is depressed. In another embodiment, a gear system is further included and couples the cam to the motor driving rotation of the cam when the internal actuator is in the second position. In further embodiments, the rotatable cam may includes its peripheral cam surface as incorporating plural or multiple recesses such that the internal actuator 18 may be captured in such recesses in several positions, of differing possible durations for timed operations along the peripheral cam surface between recesses with mechanical communication with the electrical switch powering the motor as the rotatable cam is operated by the motor for varying the operating activations of the motor.

In yet another embodiment of the invention, one or more linkages is further included in mechanical communication with the cam and one or more appendages coupled to the linkages is further included for repetitively moving the one or more appendages when the cam is rotating. In another embodiment of the invention, a pathway is in mechanical communication with the cam wherein the one or more linkages travel along the pathway with the coupled appendage which move repetitively as the cam rotates.

In another embodiment of the invention, a method for automatically shutting off a rotating cam mechanism includes the steps of providing a motor, providing a power source, providing an electrical switch in a circuit with the motor, providing an internal actuator adjacent the electrical switch, the actuator is alternately in one of a first position where the motor is not powered and a second position in mechanical communication with the electrical switch for powering the motor, and providing a rotatable cam coupled with the motor, the rotatable cam including a peripheral cam surface having a recess where the internal actuator in the first position is captured in the recess, and where the internal actuator in the second position rides along the peripheral cam surface outside the recess and is in mechanical communication with the electrical switch powering the motor while the rotatable cam is operated by the motor. The method further includes the steps of coupling a protrusion element at the cam, providing a manually operable actuator for applying a force upon the protrusion, advancing the cam forcing the internal actuator from the first position to the second position powering up the motor and rotating the cam, and further rotation of the cam will move the internal actuator to the second position automatically shutting off the motor.

In another embodiment of the invention, the internal actuator further provides a finger projection captured by the recess while in the first position and riding along the peripheral cam surface when pivoted to the second position. In another embodiment of the invention, the electrical switch further provides a leaf switch adjacent the pivoting internal actuator at an end opposite the finger projection, and further comprising the steps of pivoting the internal actuator to the second position in contact with the leaf switch closing the electrical circuit and powering the motor and pivoting the internal actuator to the first position away from contact with the leaf switch opening the electrical circuit and shutting off power to the motor.

In yet another embodiment of the invention, the manually operable actuator further provides a biased lever for advancing the cam and automatically resetting into position for further cam advancement. In another embodiment of the invention, the step of pivoting the biased lever from engagement with the cam when the protrusion contacts the lever after one cam revolution preventing inadvertent advancement of the cam if the manually operable actuator is depressed if further provided.

In still yet another embodiment of the invention, a gear system coupling the cam to the motor driving rotation of the cam is further provided. In another embodiment of the invention, one or more linkages in mechanical communication with the cam and one or more appendages coupled to the linkages for repetitively moving the one or more appendages when the cam is rotating is further provided.

In another embodiment of the invention, a cam mechanism includes a motor, an electrical power source, an electrical switch in a circuit with the motor, an internal actuator adjacent the electrical switch, the actuator alternately in one of a first position where the motor is not powered and a second position in mechanical communication with the electrical switch for powering the motor, and a rotatable cam coupled with the motor, the rotatable cam including a peripheral cam surface having a recess where the internal actuator when in the first position is captured in the recess, and where the internal actuator in the second position rides along the peripheral cam surface outside the recess and is in mechanical communication with the electrical switch powering the motor while the rotatable cam is operated by the motor. The cam mechanism further includes one or more linkages in mechanical communication with the cam, one or more appendages coupled to the linkages and repetitively movable when the cam is rotating, a protrusion element at the cam, and a manually operable actuator for applying a force upon the protrusion and advancing the cam forcing the internal actuator from the first position to the second position powering the motor and rotating the cam, further rotation of the cam will move the internal actuator to the second position automatically shutting off the motor.

In another embodiment, the internal actuator pivots between the first and second positions and further comprises a finger projection at an end of the pivoting internal actuator for riding along the peripheral cam surface and for being captured by the recess. In yet another embodiment, the manually operable actuator includes a biased lever for advancing the cam and automatically resetting into position for further cam advancement, the cam protrusion pivots the biased lever from engagement with the cam after one cam revolution preventing inadvertent advancement of the cam if the manually operable actuator is depressed.

In still yet another embodiment of the invention, the cam mechanism further includes a gear system coupling the cam to the motor driving rotation of the cam when the internal actuator is in the second position, and further comprising a pin at the gear system wherein the one or more linkages travel along the pin and repetitively move coupled appendages.

For the purpose of facilitating an understanding of the inventions, the accompanying drawings and description illustrate a preferred embodiment thereof, from which the inventions, structure, construction and operation, and many related advantages may be readily understood and appreciated.

DESCRIPTION OF THE PREFERRED EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1:
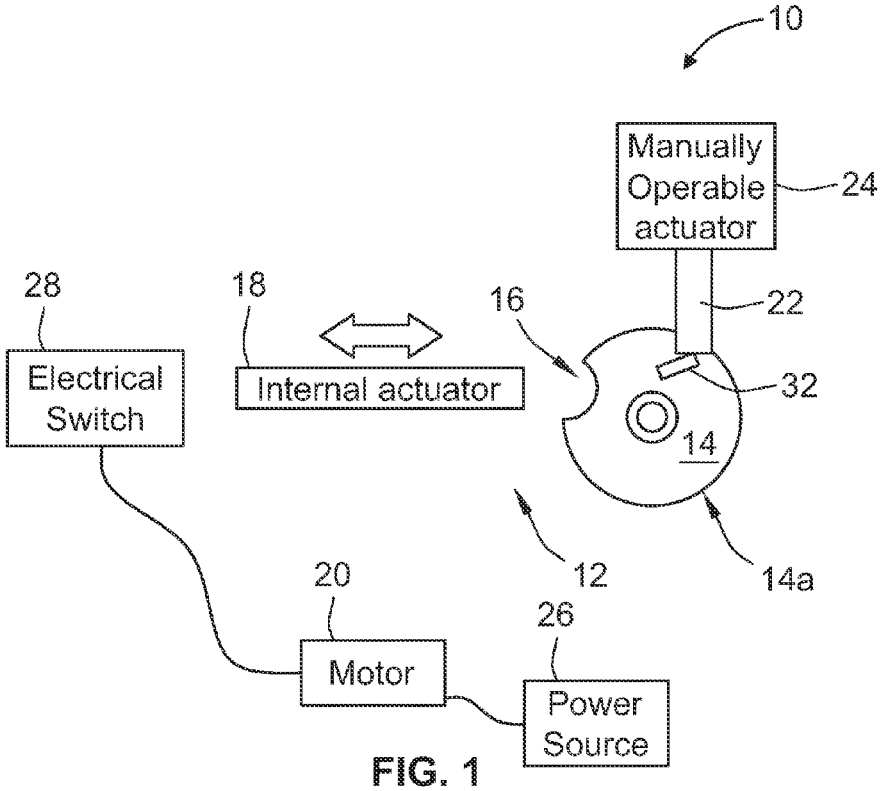
FIG. 1 is schematic block diagram of the present invention illustrating a resetting biasing lever coupled to a manually operable actuator for advancing a cam and interacting with an internal actuator which communicates with the cam and a electrical switch, turning on and off a motor.

A dual purpose cam mechanism 10, as seen in FIG. 1, is generally seen to facilitate an automatic shut off mechanism 12 preserving battery life in a toy. A rotatable cam 14 including at least one recess 16 which captures an internal actuator 18 and completely shuts down a motor 20 at a defined cam rotation to preserve the battery life in a toy. A resetting biasing lever 22, coupled to a manually operable actuator 24, advances the cam and is then moved from engagement so as to completely shut down the motor 20 at the defined cam rotation even if the manually operable actuator 24 continues to be depressed.

Figure 2:
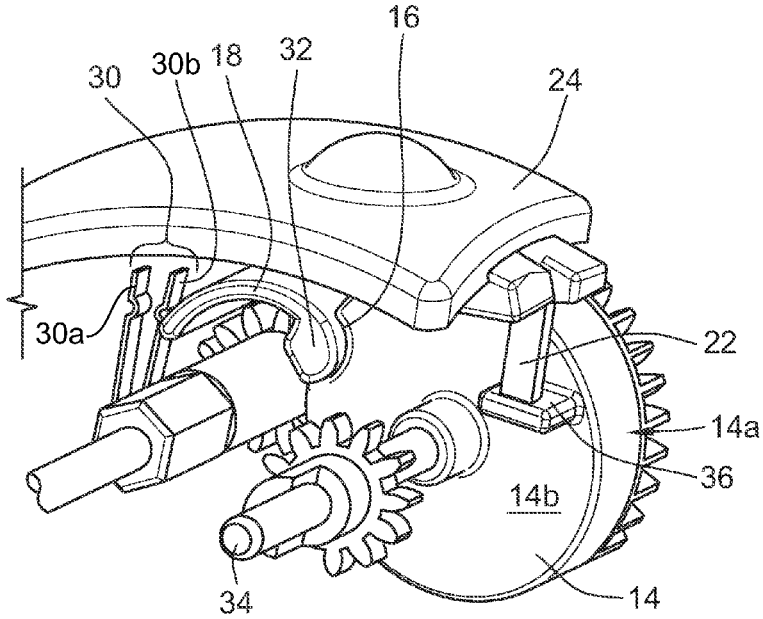
FIG. 2 is a perspective view of an embodiment of the invention illustrating the internal actuator in a first position captured in a recess of the cam and the biasing lever in an engaging position.
Figure 3:
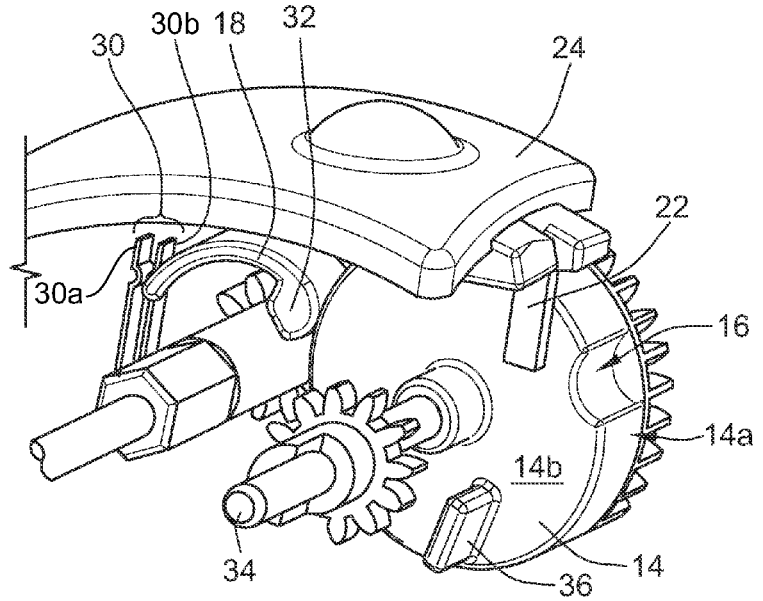
FIG. 3 is a perspective view of an embodiment of the invention illustrating the internal actuator in a second position riding along a peripheral surface of the cam outside the recess, and the biasing lever in a non-engaging position.

The cam mechanism 10, as seen in FIGS. 1-3, includes the motor 20 which is generally an electric motor of an appropriate size necessary to drive rotation of the cam 14. An electrical power source 26 is in electrical communication with the motor generating the power to run the motor, and in the present described embodiment, the cam mechanism 10 can be powered by a single AA battery. An electrical switch 28 is in a circuit with the motor 20 and when closed activates the motor 20 and when open shuts off power to the motor. In the present described embodiment, the electrical switch 28 includes a leaf switch 30, as seen in FIGS. 2 & 3, positioned adjacent the internal actuator 18 which pivots back and forth to open and close the leaf switch.

The internal actuator 18 is adjacent the electrical switch and resides alternately in one of a first position where the motor is not powered, and a second position in mechanical communication with the electrical switch for powering the motor. In the present described embodiment, the internal actuator pivots between first position, as seen in FIG. 2 and second position, as seen in FIG. 3.

The internal actuator can include several different shapes, such as rectangular, etc. which will efficiently pivot between first and second positions and operate to as a momentary actuator turning on and off the motor 20. In the present described embodiment, the internal actuator 18 is crescent shaped and mounted on shaft 59 providing stability to the actuator 18 as it pivots between first and second positions. The internal actuator further includes a finger projection 32 at an end of the pivoting internal actuator for being captured by the recess 16, as seen in FIG. 2.

The leaf switch 30 is adjacent the internal actuator at an end of the actuator 18 opposite the finger projection 32 and includes two prongs 30*a* & 30*b*. The leaf switch 30 is capable of closing the electrical circuit powering the motor when in contact with the internal actuator in the second position forcing prongs 30*a* & 30*b* to contact one another, as seen in FIG. 3. The leaf switch 30 is also capable of opening the electrical circuit shutting off power to the motor when the internal actuator is in the first position and pivoted away from the leaf switch allowing prongs 30*a* & 30*b* to move from contacting each other, as seen in FIG. 2.

The rotatable cam 14, as seen in FIGS. 2 & 3 is coupled with the motor 20 and rotates on shaft 34. The rotatable cam 14 includes a peripheral cam surface 14*a* which incorporates the recess 16. The internal actuator 18, when in the first position, is captured in the recess, as mentioned above, and when in the second position, as seen in FIG. 3, rides along the peripheral cam surface 14*a* outside the recess and is in mechanical communication with the electrical switch powering the motor while the rotatable cam is operated by the motor. The internal actuator operates as a cam follower traveling along cam surface 14*a* until captured in cam recess 16. In the present described embodiment, the finger projection 32 rides along the peripheral cam surface 14*a*, as seen in FIG. 3, until being captured in the recess 16, as described above. In further embodiments, the rotatable cam 14 may includes its peripheral cam surface 14*a* as incorporating two or more recesses 16, such that the internal actuator 18 may be captured in such recesses in several positions, of differing possible durations for timed operations along the peripheral cam surface 14*a* outside the recess, in mechanical communication with the electrical switch powering the motor as the rotatable cam is operated by the motor for varying the operating activations of the motor.

A protrusion element 36 of the present described embodiment is included at the cam 14, as seen in FIG. 2, on a surface 14*b* of the cam for engagement with the manually operable actuator 24. The manually operable actuator 24, when depressed, applies a force upon the protrusion 36 advancing the cam 14 and forcing the internal actuator 18 from the first position to the second position powering up the motor 20 and rotating the cam 14. Further rotation of the cam will then move the internal actuator 18 to the second position automatically shutting off the motor at a defined cam rotation. In the single recess 16 embodiment described, after one cam rotation, the internal actuator will be captured in the recess 16 and pivoted to the first position automatically shutting off power to the motor. Thusly the internal actuator 18 facilitates limited activations of the motor for automatically shutting off a rotating cam mechanism to prevent repetitive continued operation. Further the internal actuator 18 movement from the first position to the second position may provide powering up the motor 20 and rotating the cam 14 for "try me" operation for limited demonstrative operations of the toy while packaged or configured in a point of sale environment.

Figure 4:
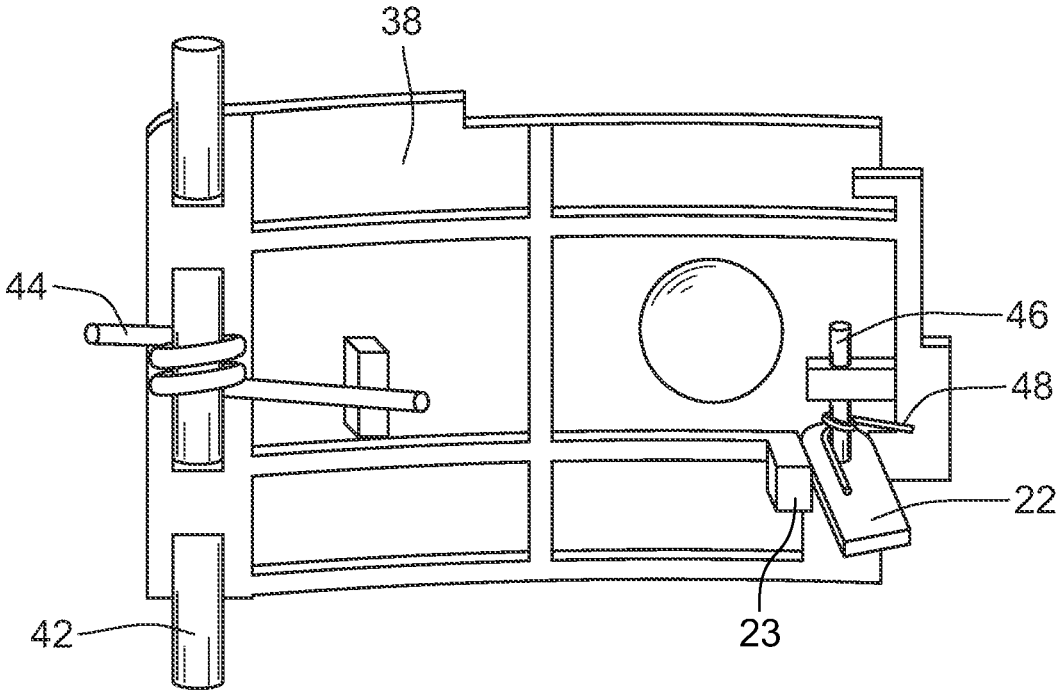
FIG. 4 illustrates an embodiment of the manually operable actuator and coupled biasing lever.
Figure 5:
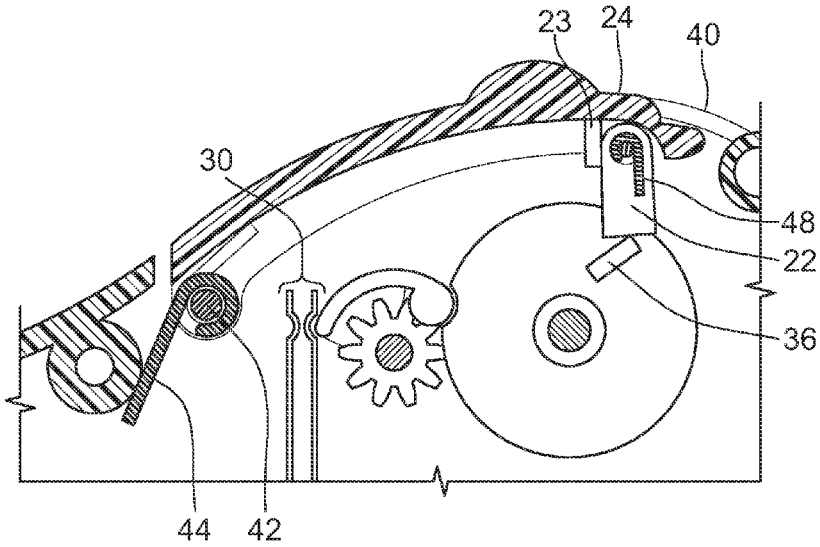
FIG. 5 illustrates the manually operable actuator in an inactive position with coupled biasing lever in an engaging position.
Figure 6:
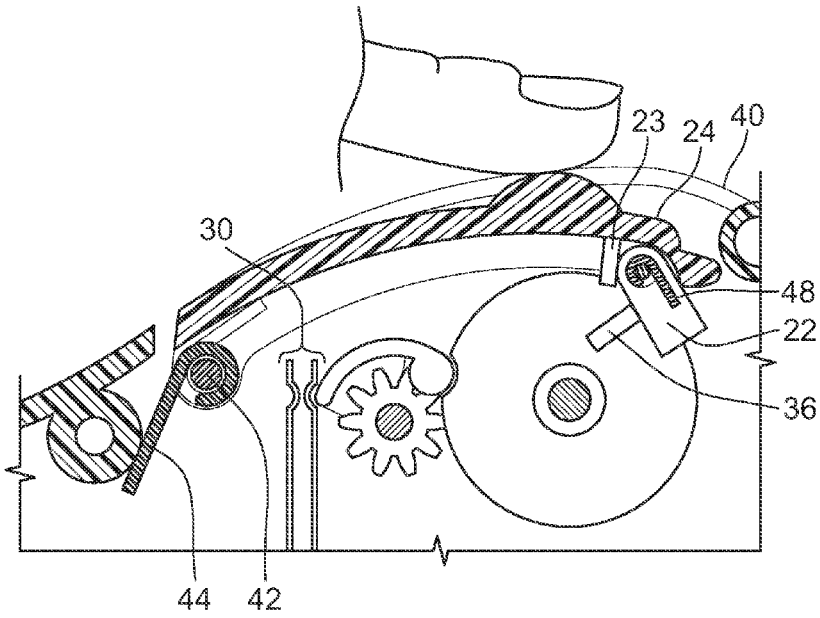
FIG. 6 illustrates the manually operable actuator in an active position with coupled biasing lever in a non-engaging position as a protrusion displaces the biasing lever from engagement to prevent advancement of the cam even if the manually operable actuator continues to be depressed to the active position.

In the present described embodiment, the manually operable actuator 24, as seen in FIGS. 4-6, includes a plate 38 pivotally coupled to a housing 40 of a toy at a pivoting pin 42. The manually operable actuator 24 is pivotable between an inactive position where the actuator 24 is not depressed, as seen in FIG. 5, and an active position where the actuator 24 is depressed into the housing 40 to advance the cam 14, as seen in FIG. 6. The plate 38 is biased to the inactive position which does not depress the protrusion 36 of cam 14, but rests at the protrusion 36 ready for future cam advancement when desired by a user, as seen in FIG. 5.

In the present described embodiment, a spring 44 biases plate 38 to the inactive position. The user desiring to activate the toy depresses actuator 24 into the housing 40 moving the actuator 24 from the inactive position to the active position which then advances the cam 14, as seen in FIGS. 3 & 6. If the actuator 24 does not continue to be depressed spring 44 will automatically return the actuator 24 to the inactive position, ready again for future cam advancement.

In the present described embodiment, the manually operable actuator 24 further includes the biasing lever 22 for advancing the cam 14, as seen in FIGS. 2-6. The biasing lever 22 is pivotally coupled to plate 38 at pivoting pin 46, at a side of plate 38 opposite pivoting pin 42, as seen in FIG. 4. Lever 22 is pivotable between an engaging position, as seen in FIGS. 2 & 5, and non-engaging position, as seen in FIGS. 3 & 6, and is biased toward the engaging position. A stop 23 coupled to plate 38 facilitates the correct positioning of lever 22 when lever 22 is in the engaging position.

In the present described embodiment, a spring 48 biases the lever 22 to the engaging position at stop 23, such that after lever 22 advances cam 14, as seen in FIG. 3, lever 22 automatically resets into position for further cam advancement. Additionally, if the manually operable actuator 24 continues to be depressed, after one revolution of the cam, the protrusion 36 will pivot biased lever 22 from engagement into the non-engaging position, as seen in FIG. 6, preventing inadvertent advancement of the cam 14 and drain on the power source 26. Preventing lever 22 from returning to an engaging position when manual actuator 24 is held in the active position, maintains the complete shut down of motor 20 at a defined cam rotation, even if the manually operable actuator 24 continues to be intentionally or unintentionally depressed, as seen in FIG. 6.

For example, if a user holds down actuator 24 or the toy is put in a box or backpack, etc. where the actuator 24 is held in the active position for what at times can be a long period of time, the protrusion 36 keeps lever 22 in the non-engaging position to maintain the automatic shut off of motor 20, as seen in FIG. 6, preventing the battery from being drained and wasted while the toy sits in a box, etc.

Figure 7:
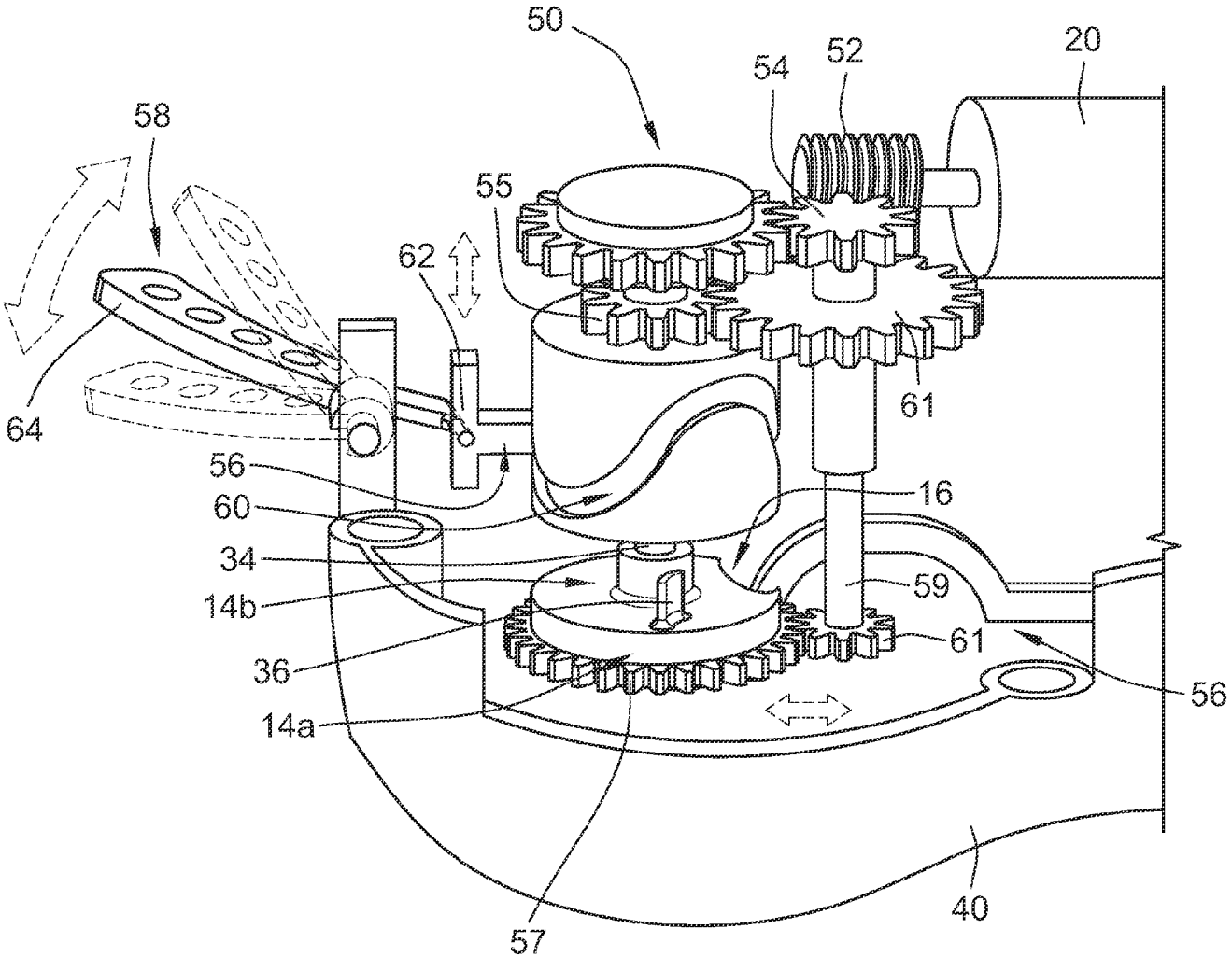
FIG. 7 is a perspective view of an embodiment of the invention illustrating a gear system and one or more linkages with one or more coupled appendages.

In the present described embodiment, a gear system 50, as seen in FIG. 7, couples the cam 14 to the motor 20 driving rotation of the cam when the internal actuator 18 is in the second position. A worm gear 52 rotates a first gear 54 on shaft 59 which in turn rotates the remaining gears in the system simultaneously rotating coupled cam 14 when the motor is activated. The gear system 50 includes gears 55 & 57 which are mounted on shaft 34 straddling cam 14 to provide both efficient and reliable rotating of cam 14 and also the halting of rotation of cam 14 at a desired cam rotation. Additional gears 61 of the gear system 50 are mounted on shaft 59 which sits adjacent shaft 34 and helps facilitate the efficient and reliable rotating and halting of cam 14.

Figure 8:
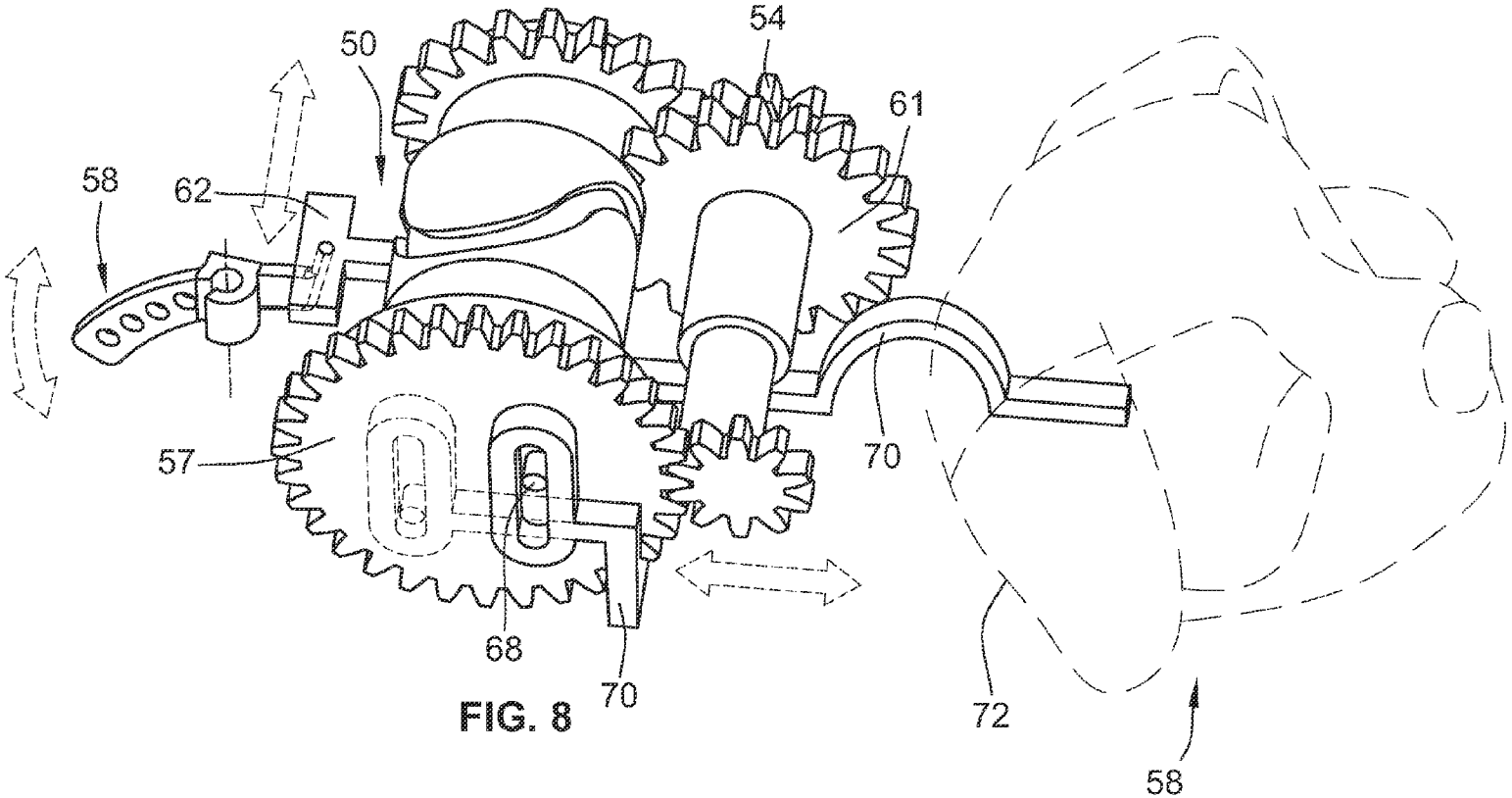
FIG. 8 illustrates one or more linkages with one or more coupled appendages engaging a pin coupled to a gear of the gear system.

The dual purpose cam mechanism 10 for repetitively moving one or more appendages and facilitating an automatic shut off mechanism in a toy further includes one or more linkages 56 in mechanical communication with the cam 14, as seen in FIGS. 7 & 8. Additionally, one or more appendages 58 are coupled to the linkages for repetitively moving the one or more appendages when the cam is rotating. In the present described embodiment, a pathway 60 is in mechanical communication with the cam 14 and one or more linkages 56 travel along the pathway with coupled appendages 58 which are moved repetitively as the cam rotates.

As seen in FIG. 7, the pathway 60 is coupled to gear 55 on shaft 34 adjacent cam 14 and is rotated simultaneously with cam 14. The undulating pathway 60 facilitates the up and down movement of linkage 62 translating into an up and down movement of coupled appendage 64, simulating a waging tail, as seen in FIG. 7.

Additionally, a pin 68 is included at the gear system 50 and the one or more linkages 56 travel along the pin and repetitively move coupled appendages 58, as seen in FIG. 8. In the present described embodiment, pin 68 is coupled to gear 57 and linkage 70 rides along pin 68 as gear 57 is rotated by gear system 50. Appendage 72 is coupled to linkage 70 and is repetitively moved back and forth and up and down as linkage 70 travels along pin 68 simulating a toy head moving up and down as gear system 50 and cam 14 simultaneously rotate. It is also contemplated that additional linkages coupled to additional appendages cam be included to further enhance the fun and life like animation of the toy.

Figure 9:
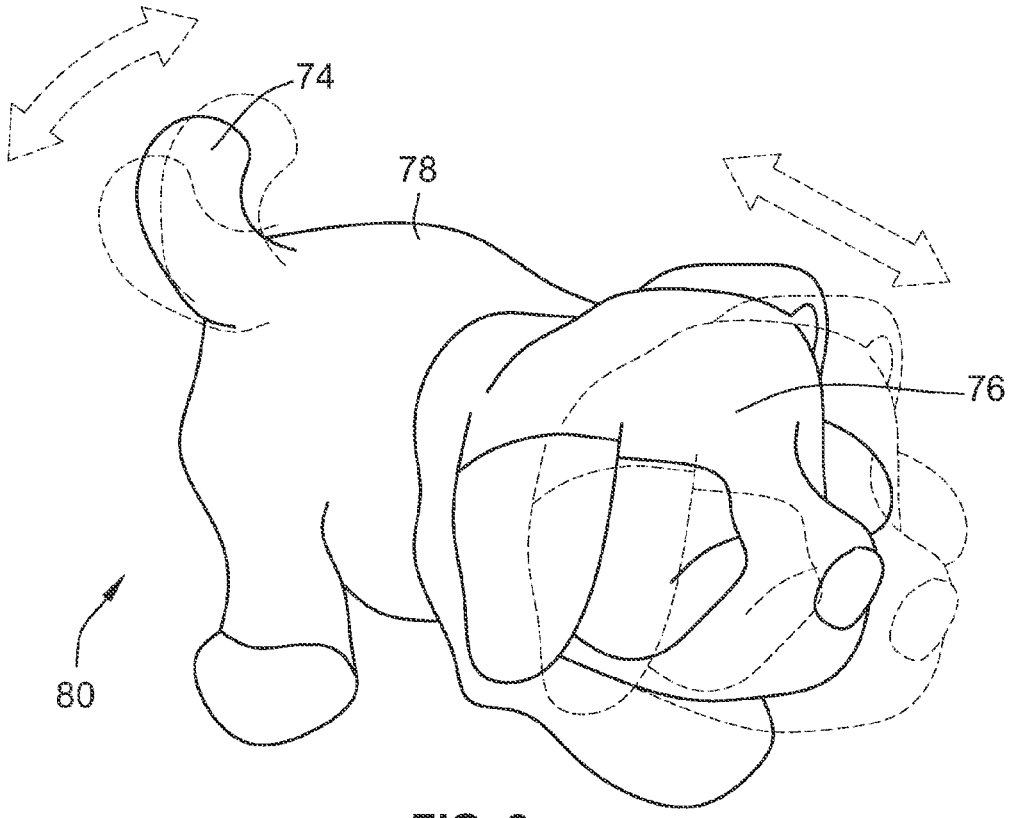
FIG. 9 is an embodiment of the invention illustrating a small toy embodied in a puppy with movable appendages in a fun and life like manner incorporating an automatic shut off mechanism of the present invention preserving battery life in the toy.

In the present described embodiment, an electromechanical toy embodied as a puppy 80, as seen in FIG. 9, incorporates the momentary actuator dual purpose cam mechanism 10. The cam mechanism 10 seen repetitively and simultaneously moves appendages 58 & 72 as cam 14 rotates, simulating a tail 74 wagging and a puppy head 76 raising up and then lowering again. The manually operable actuator 24 is positioned on the back 78 of the toy puppy 80 such that as a user pets the puppy's back 78 the tail 74 will wag and the head 76 will rise up as if to great the user. The internal actuator 18 within the housing 40 of the puppy will completely shut down the motor 20 at a defined cam revolution, even if a manually operable actuator 24 continues to be depressed, preserving the battery life of the toy puppy. If the user intentionally holds down actuator 24 or it is inadvertently held down in packaging or during storage of the puppy, etc, the cam mechanism 10 will facilitate the capture of the internal actuator 18 completely shutting down the motor after one cam revolution to preserve battery life.

A method for automatically shutting off a rotating cam mechanism includes the steps of providing a motor, providing a power source, providing an electrical switch in a circuit with the motor, providing an internal actuator adjacent the electrical switch, the actuator is alternately in one of a first position where the motor is not powered and a second position in mechanical communication with the electrical switch for powering the motor and providing a rotatable cam coupled with the motor, the rotatable cam including a peripheral cam surface having a recess where the internal actuator in the first position is captured in the recess, and where the internal actuator in the second position rides along the peripheral cam surface outside the recess and is in mechanical communication with the electrical switch powering the motor while the rotatable cam is operated by the motor. Further including the steps of coupling a protrusion element at the cam, providing a manually operable actuator for applying a force upon the protrusion, and advancing the cam forcing the internal actuator from the first position to the second position powers up the motor and rotates the cam. Further rotation of the cam will move the internal actuator to the second position automatically shutting off the motor.

The internal actuator further provides a finger projection captured by the recess while in the first position and riding along the peripheral cam surface when pivoted to the second position. The electrical switch further provides a leaf switch adjacent the pivoting internal actuator at an end opposite the finger projection, and further comprising the steps of pivoting the internal actuator to the second position in contact with the leaf switch closing the electrical circuit and powering the motor and pivoting the internal actuator to the first position away from contact with the leaf switch opening the electrical circuit and shutting off power to the motor.

The manually operable actuator further provides a biased lever for advancing the cam and automatically resetting into position for further cam advancement, and the methods further includes the step of pivoting the biased lever from engagement with the cam when the protrusion contacts the lever after one cam revolution preventing inadvertent advancement of the cam if the manually operable actuator is depressed.

The methods further include the step of providing a gear system coupling the cam to the motor driving rotation of the cam, and the step of further providing one or more linkages in mechanical communication with the cam and one or more appendages coupled to the linkages for repetitively moving the one or more appendages when the cam is rotating.

From the foregoing it can be seen that there has been provided a unique low cost cam mechanism for creating fun and life like animation in a toy with moving appendages while preserving the battery life by facilitating an automatic shut off mechanism. While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set fourth in the foregoing description and accompanying drawings is offered by way of illustration only and not as a limitation. The actual scope of the invention is intended to be defined in the following claims when viewed in their proper perspective based on the prior art.

What is claimed is:

1. A cam mechanism facilitating an automatic shut off mechanism for a toy, comprising:

a motor;

an electrical power source;

an electrical switch in a circuit with the motor;

an internal actuator adjacent the electrical switch, the actuator is alternately in one of a first position where the motor is not powered and a second position in mechanical communication with the electrical switch for powering the motor;

a rotatable cam coupled with the motor, the rotatable cam including a peripheral cam surface having a recess where the internal actuator in the first position is captured in the recess, and where the internal actuator in the second position rides along the peripheral cam surface outside the recess and is in mechanical communication with the electrical switch powering the motor while the rotatable cam is operated by the motor;

a protrusion element at the cam; and a manually operable actuator for applying a force upon the protrusion and advancing the cam forcing the internal actuator from the first position to the second position powering up the motor and rotating the cam, further rotation of the cam will move the internal actuator to the second position automatically shutting off the motor.

2. The cam mechanism according to claim 1, wherein the internal actuator pivots between the first and second positions and further comprises a finger projection at an end of the pivoting internal actuator for riding along the peripheral cam surface and for being captured by the recess.

3. The cam mechanism according to claim 2, wherein the electrical switch includes a leaf switch adjacent the pivoting internal actuator at an end opposite the finger projection.

4. The cam mechanism according to claim 3, wherein the leaf switch closes the electrical circuit powering the motor when in contact with the pivoting internal actuator in the second position, and opens the electrical circuit shutting off power to the motor when the pivoting internal actuator is in the first position and pivoted away from contact with the leaf switch.

5. The cam mechanism according to claim 1, wherein the manually operable actuator includes a biasing lever for advancing the cam and automatically resetting into position for further cam advancement.

6. The cam mechanism according to claim 5, wherein the protrusion pivots the biased lever from engagement with the cam after one cam revolution preventing inadvertent advancement of the cam if the manually operable actuator is depressed.

7. The cam mechanism according to claim 6, further comprising a gear system coupling the cam to the motor driving rotation of the cam when the internal actuator is in the second position.

8. The cam mechanism according to claim 1, further comprising one or more linkages in mechanical communication with the cam and one or more appendages coupled to the linkages for repetitively moving the one or more appendages when the cam is rotating.

9. The cam mechanism according to claim 8, further comprising a pathway in mechanical communication with the cam wherein the one or more linkages travel along the pathway with the coupled appendage which are moved repetitively as the cam rotates.

10. A method for automatically shutting off a rotating cam mechanism, comprising the steps of:

providing a motor;

providing a power source;

providing an electrical switch in a circuit with the motor;

providing an internal actuator adjacent the electrical switch, the actuator is alternately in one of a first position where the motor is not powered and a second position in mechanical communication with the electrical switch for powering the motor;

providing a rotatable cam coupled with the motor, the rotatable cam including a peripheral cam surface having a recess where the internal actuator in the first position is captured in the recess, and where the internal actuator in the second position rides along the peripheral cam surface outside the recess and is in mechanical communication with the electrical switch powering the motor while the rotatable cam is operated by the motor;

coupling a protrusion element at the cam;

providing a manually operable actuator for applying a force upon the protrusion;

advancing the cam forcing the internal actuator from the first position to the second position powering up the motor and rotating the cam; and further rotation of the cam will move the internal actuator to the second position automatically shutting off the motor.

11. The method according to claim 10, wherein the internal actuator further provides a finger projection captured by the recess while in the first position and riding along the peripheral cam surface when pivoted to the second position.

12. The method according to claim 11, wherein the electrical switch further provides a leaf switch adjacent the pivoting internal actuator at an end opposite the finger projection, and further comprising the steps of pivoting the internal actuator to the second position in contact with the leaf switch closing the electrical circuit and powering the motor and pivoting the internal actuator to the first position away from contact with the leaf switch opening the electrical circuit and shutting off power to the motor.

13. The method according to claim 10, wherein the manually operable actuator further provides a biased lever for advancing the cam and automatically resetting into position for further cam advancement.

14. The method according to claim 13, further comprising the step of pivoting the biased lever from engagement with the cam when the protrusion contacts the lever after one cam revolution preventing inadvertent advancement of the cam if the manually operable actuator is depressed.

15. The method according to claim 13, further providing a gear system coupling the cam to the motor driving rotation of the cam.

16. The method according to claim 10, further providing one or more linkages in mechanical communication with the cam and one or more appendages coupled to the linkages for repetitively moving the one or more appendages when the cam is rotating.

17. A combination cam mechanism repetitively moving one or more appendages and facilitating an automatic shut off mechanism for a toy, comprising:

a motor;

an electrical power source;

an electrical switch in a circuit with the motor;

an internal actuator adjacent the electrical switch, the actuator alternately in one of a first position where the motor is not powered and a second position in mechanical communication with the electrical switch for powering the motor;

a rotatable cam coupled with the motor, the rotatable cam including a peripheral cam surface having a recess where the internal actuator when in the first position is captured in the recess, and where the internal actuator in the second position rides along the peripheral cam surface outside the recess and is in mechanical communication with the electrical switch powering the motor while the rotatable cam is operated by the motor;

one or more linkages in mechanical communication with the cam;

one or more appendages coupled to the linkages and repetitively movable when the cam is rotating;

a protrusion element at the cam; and a manually operable actuator for applying a force upon the protrusion and advancing the cam forcing the internal actuator from the first position to the second position powering the motor and rotating the cam, further rotation of the cam will move the internal actuator to the second position automatically shutting off the motor.

18. The cam mechanism according to claim 17, wherein the internal actuator pivots between the first and second positions and further comprises a finger projection at an end of the pivoting internal actuator for riding along the peripheral cam surface and for being captured by the recess.

19. The cam mechanism according to claim 18, wherein the manually operable actuator includes a biased lever for advancing the cam and automatically resetting into position for further cam advancement, the cam protrusion pivots the biased lever from engagement with the cam after one cam revolution preventing inadvertent advancement of the cam if the manually operable actuator is depressed.

20. The cam mechanism according to claim 17, further comprising a gear system coupling the cam to the motor driving rotation of the cam when the internal actuator is in the second position, and further comprising a pin at the gear system wherein the one or more linkages travel along the pin and repetitively move coupled appendages.

* * * * *